US007552738B2

(12) United States Patent
Shin

(10) Patent No.: US 7,552,738 B2
(45) Date of Patent: Jun. 30, 2009

(54) DISHWASHER AND DOOR LOCKING DEVICE FOR THE SAME

(75) Inventor: Kap Soo Shin, Choongchungbook-do (KR)

(73) Assignee: LG Electronics Inc., Seoul (KR)

( * ) Notice: Subject to any disclaimer, the term of this patent is extended or adjusted under 35 U.S.C. 154(b) by 768 days.

(21) Appl. No.: 11/132,346

(22) Filed: May 19, 2005

(65) Prior Publication Data

US 2005/0257813 A1 Nov. 24, 2005

(30) Foreign Application Priority Data

May 20, 2004 (KR) ..... 10-2004-0035896

(51) Int. Cl.
*B08B 13/00* (2006.01)

(52) U.S. Cl. ..... 134/57 DL; 134/58 DL; 68/12.26

(58) Field of Classification Search ..... 134/57 DL, 134/58 DL, 184, 198; 68/12.26
See application file for complete search history.

(56) References Cited

U.S. PATENT DOCUMENTS

| | | | | |
|---|---|---|---|---|
| 3,024,074 | A * | 3/1962 | Jacobs et al. | 134/107 |
| 3,244,830 | A | 4/1966 | Bates | |
| 3,323,822 | A * | 6/1967 | Yake | 292/226 |
| 3,328,062 | A * | 6/1967 | Geiger et al. | 292/123 |
| 3,415,961 | A * | 12/1968 | Barnard | 200/61.64 |
| 3,854,762 | A * | 12/1974 | Spiegel et al. | 292/197 |
| 5,356,186 | A * | 10/1994 | Favaro | 292/216 |
| 5,440,103 | A * | 8/1995 | Martin | 219/413 |
| 6,155,616 | A * | 12/2000 | Akright | 292/207 |
| 6,390,518 | B1 | 5/2002 | Elick | |
| 7,210,711 | B2 * | 5/2007 | Dirnberger et al. | 292/68 |
| 7,306,266 | B2 * | 12/2007 | Hapke et al. | 292/218 |

FOREIGN PATENT DOCUMENTS

| | | | |
|---|---|---|---|
| DE | 44 24 201 | A1 | 1/1996 |
| DE | 196 01 229 | * | 7/1997 |
| EP | 0 727 178 | A2 | 8/1996 |
| EP | 0 917 853 | A1 | 5/1999 |
| FR | 2 429 312 | | 1/1980 |

OTHER PUBLICATIONS

European Patent Office 0 354 191 Feb. 1990.*

* cited by examiner

*Primary Examiner*—Frankie L Stinson
(74) *Attorney, Agent, or Firm*—Birch, Stewart, Kolasch & Birch, LLP

(57) ABSTRACT

A dishwasher and door locking device is provided. In the dishwasher, a tub forms a washing chamber, a door opens and closes a front of the tub, a latch lock has a tub insertion portion inserted in an upper edge of the tub and a latch lock ring formed at a front of the tub insertion portion with a hole having a predetermined size, a latch includes a latch holder and a latch link pivotably connected to a lower end of the latch holder, a latch body is fixed in the door to accommodate the latch, and at least one detection switch is attached to the latch body to detect opening and closing of the door. The latch holder is inserted in the door and formed with a notched portion at a front for coupling with the latch lock.

9 Claims, 6 Drawing Sheets

DISHWASHER AND DOOR LOCKING DEVICE FOR THE SAME

BACKGROUND OF THE INVENTION

1. Field of the Invention

The present invention relates to a dishwasher, and more particularly, to a dishwasher and door locking device for the same, in which a latch body and a latch can be easily connected to each other and a switch attached to the latch body is securely protected from a washing water to prevent an electrical trouble.

2. Description of the Related Art

A dishwasher is an electrically operated machine that washes, rinses, and dries dishes and utensils by strongly spraying water to the dishes and utensils.

The dishwasher includes a tub forming a washing chamber, an extendable dish rack installed in the tub, a sump installed at a lower portion of the tub to store a washing water, a washing pump for pumping the washing water of the sump, and a spray nozzle for directing the pumped washing water to dishes and utensils.

Also the dishwasher includes a door pivotably installed at a front of the tub. The door is hinged to the tub at its lower portion, such that the door can be rotated about the lower portion in forward and backward directions. Therefore, a user can open and close the door by pulling and pushing a handle formed at an upper portion of the door.

To prevent the closed door from being opened by itself, a door locking device is installed between the door and the tub.

FIG. 1 is a front view of a door locking device according to the related art, and FIG. 2 is a rear view of the door locking device depicted in FIG. 1.

Referring to FIGS. 1 and 2, a door locking device of the related art is designed to be installed in a door.

The door locking device includes a latch body 10 and a latch 20. The latch 20 is disposed in the latch body 10 for coupling with a latch lock (not shown) protruded from a front upper portion of a tub.

The latch 20 includes a latch holder 21 and a latch link 22 connected to a lower end of the latch holder 21. The latch holder 21 includes a notched portion 27 at a front for coupling with the latch lock. The latch holder 21 and the latch link 22 are connected using a variable hinge 26. The variable hinge 26 pivotably connects the latch holder 21 with the latch link 22 and it is a movable hinge.

A latch spring 23 is fitted around the latch link 22, and the latch link 22 is formed with a latch link hinge 24 at a lower end for coupling with the latch body 10.

The latch body 10 includes a door wing 15, a latch lock inserting hole 11, and a switch receiving portion 12. The door wing 15 is to be fixed to an inside of the door, the latch lock inserting hole 11 is defined in a center of the door wing 15, and the switch receiving portion 12 is formed at a lower end of the latch body 10.

Also, the latch body 10 includes an over-rotation preventing board 14 at a rear to prevent the latch holder 21 from over rotation. A door handle 30 is connected to a lower rear lower of the latch body 10 via a hinge. In detail, the latch body 10 defines handle hinge holes 13 at both lower sides, and a handle hinge pin 33 is inserted through the handle hinge holes 13 and knuckle portions of the door handle 30. Also, a handle spring 32 is fitted around a middle portion of the handle hinge pin 33, such that the handle 30 can return to its initial position when rotated.

A door switch 40 is seated on the switch receiving portion 12 formed at the lower end of the latch body 10. The door switch 40 includes a contact terminal 41 protruded on a top, and the door handle 30 includes a protruded depressing portion 31 at a front. The depressing portion 31 is abutted on the contact terminal 41. Therefore, when a user pulls the door handle 30 to open the door, the door handle 30 is rotated upward and the depressing portion 31 depresses the contact terminal 41 of the door switch 40. Upon the depressing of the contact terminal 41, the opening of the door is detected and a dish-washing operation is terminated.

As described above, the door locking device of the related art is designed such that the top of the door switch 40 is opened to allow the depressing portion 31 to press the contact terminal 41 of the door switch 40.

Further, a washing water can permeate into the latch body 10 through the latch holder 21, and it can flows down along the inner wall of the latch link 22 or the latch body 10. Therefore, the door switch 40 can be damaged when the washing water drops from the inner wall of the latch link 22 or from the latch body 10 to the opened top of the switch 40.

Furthermore, an additional pin is required to fix the latch holder 21 to the latch body 10.

In addition, the over-rotation preventing board 14, which is formed at the rear of the latch body 10 to prevent the latch holder 21 from over-rotation, makes it hard to install the latch 20 in the latch body 10.

SUMMARY OF THE INVENTION

Accordingly, the present invention is directed to a dishwasher and door locking device for the same that substantially obviates one or more problems due to limitations and disadvantages of the related art.

An object of the present invention is to provide a dishwasher and door locking device for the same, in which a latch and a latch body can be easily assembled, and a washing water is prevented from permeating into a micro switch attached to the latch body to prevent electrical troubles of the micro switch.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher includes: a tub in which a washing chamber is formed; a door opening and closing a front of the tub; a latch lock having a tub insertion portion inserted in an upper edge of the tub and a latch lock ring formed at a front of the tub insertion portion, the latch rock ring defining a hole with a predetermined size; a latch including a latch holder and a latch link pivotably connected to a lower end of the latch holder, the latch holder being inserted in a door and being formed with a notched portion at a front for coupling with the latch lock; a latch body fixed in the door to accommodate the latch; and at least one detection switch attached to the latch body to detect opening and closing of the door.

In another aspect of the present invention, a door locking device for a dishwasher, includes: a latch lock installed at an upper edge of a tub; a latch including a latch holder and a latch link pivotably connected to a lower end of the latch holder, the latch holder being inserted in a door and being formed with a notched portion at a front for coupling with the latch lock; a latch body accommodating the latch, an upper side and/or a lower side of the latch being hinged to the latch body; and at least one detection switch attached to the latch body to detect opening and closing of the door.

In a further another aspect of the present invention, a door locking device for a dishwasher, includes: a latch including a latch holder, a latch link connected to a lower end of the latch holder, and a hinge portion integrally formed at a side of the latch holder and/or the latch link; a latch body having an opened back from which the latch is inserted and a hinge inserting hole at a side for coupling with the hinge portion; at least one detection switch attached to a side of the latch body to detect opening and closing of a door; and a latch lock provided to be hooked by a front portion of the latch holder.

According to the present invention, the latch and the latch body can be assembled through one process, and the micro switch can be protected from water.

Further, a contact lever is integrally formed with the latch holder, such that a contact detection part of the detection switch can make contact with the contact lever more exactly. Therefore, the opening and closing of the door can be more securely detected.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
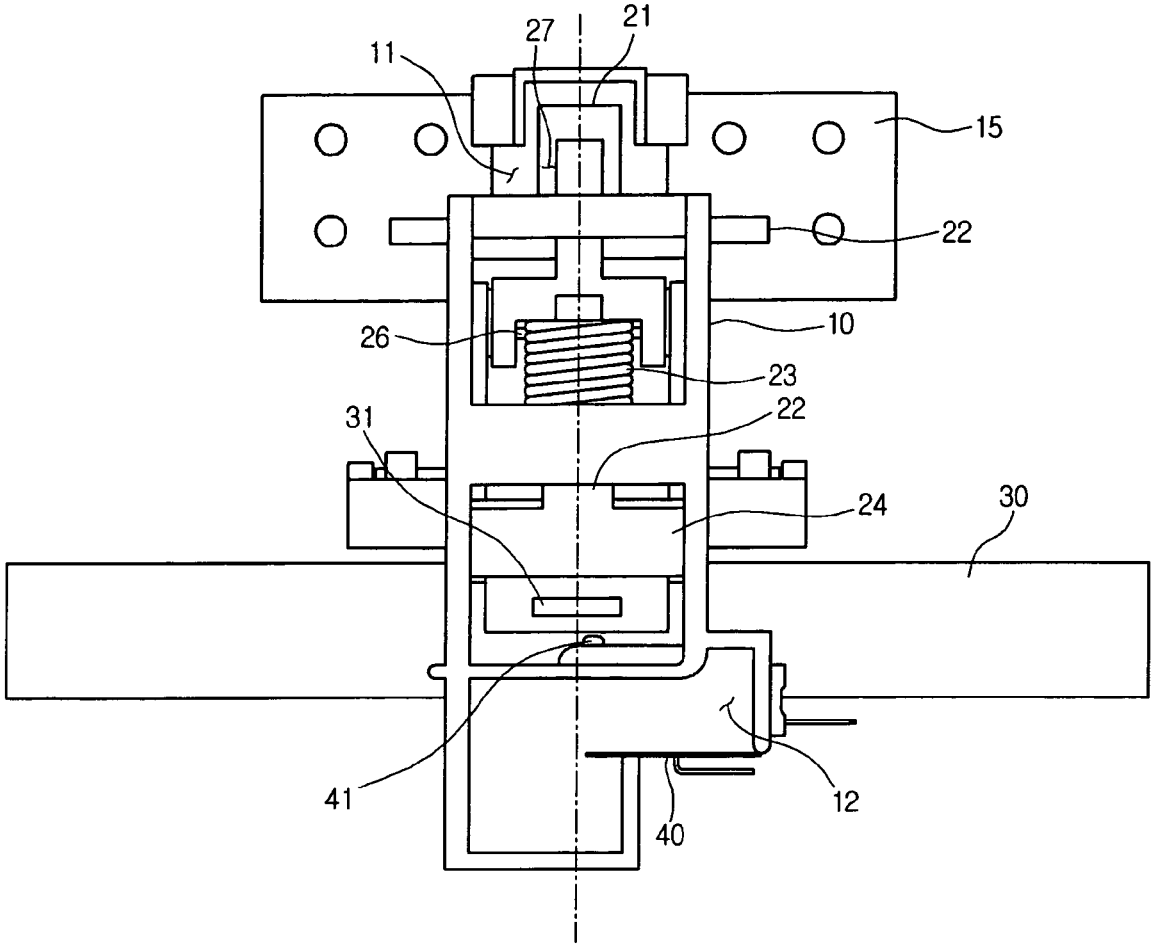
FIG.1 Related Art
FIG. 1 is a front view of a door locking device according to the related art.
Figure 2:
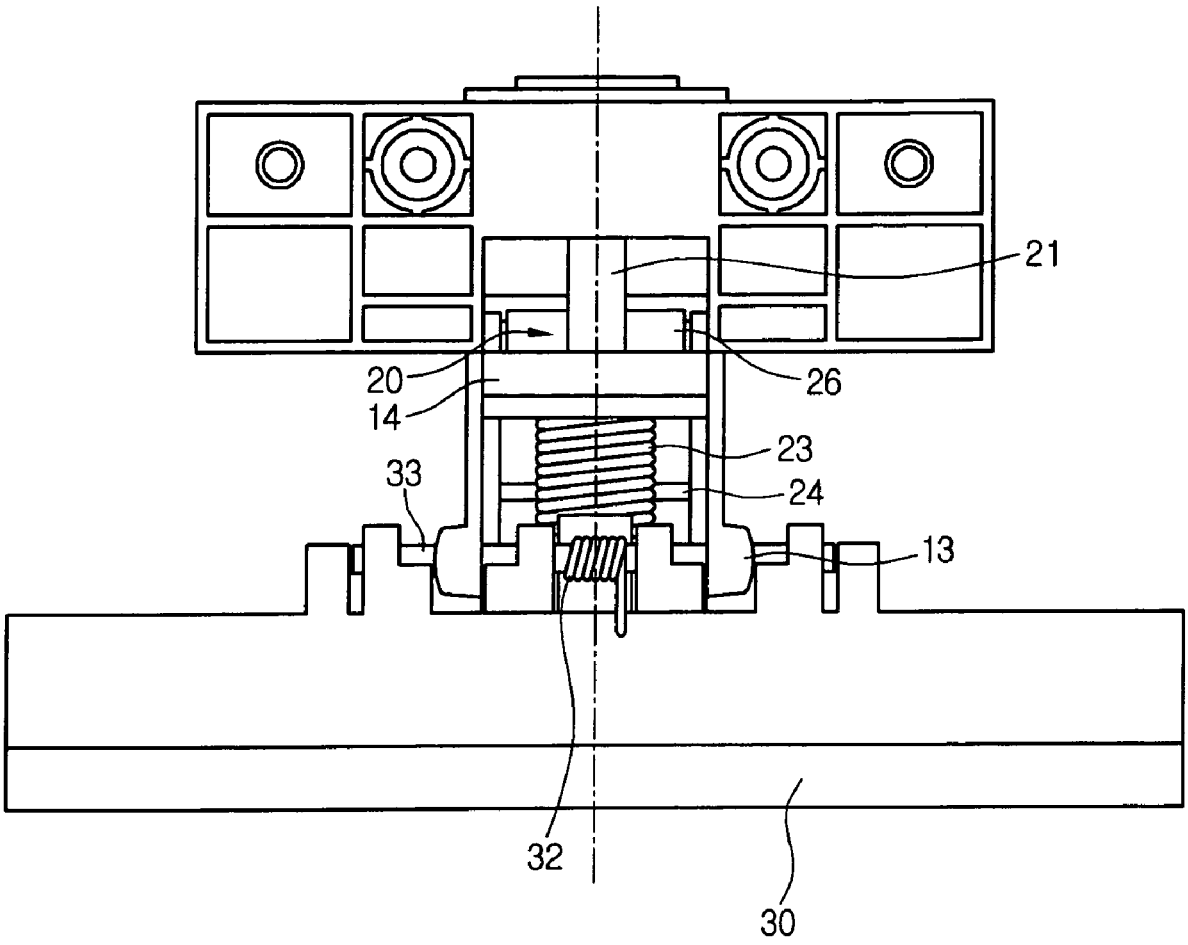
FIG.2 Related Art
FIG. 2 is a rear view of the door locking device depicted in FIG. 1.
Figure 3:
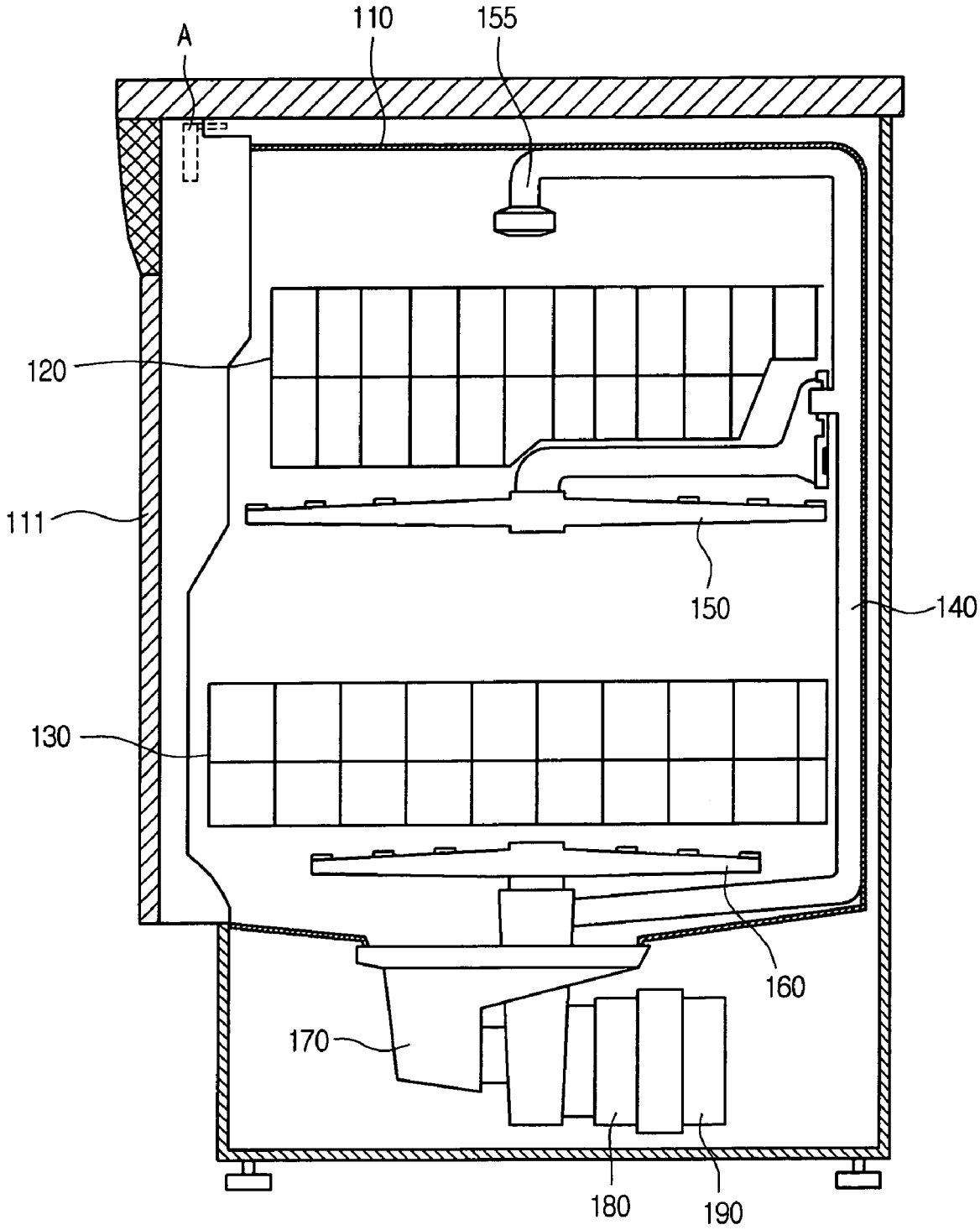
FIG. 3 is a schematic section of a dishwasher with a door locking device according to the present invention.

FIG. 3 is a schematic section of a dishwasher with a door locking device according to the present invention;

Referring to FIG. 3, a door locking device (A) of the present invention is installed between upper portions of a door and a tub of a dishwasher.

In detail, a dishwasher 100 of the present invention includes a tub 110 forming the outside of the dishwasher 100 and defining a washing chamber inside, a door 111 pivotably installed at a front of the tub 110 to open and close the door 111, and a sump 170 installed at a bottom center of the tub 110 to collect a washing water.

Also, the dishwasher 100 includes a washing pump 180 and a motor 190. The washing pump 180 is connected to the sump 170 to pump the washing water of the sump 170 at a high pressure, and the motor 190 is connected to a back of the washing pump 180 to drive it.

Further, the dishwasher 100 includes a water guide 140 through which the pumped washing water passes, a lower nozzle 160 mounted on the sump 170 to spray the washing water upwardly, an upper nozzle 150 disposed along a middle line of the tub 110 in connection with the water guide 140 to spray the washing water upwardly and/or downwardly, and a top nozzle 155 connected to a terminating end of the water guide 140 to spray the washing water downwardly from a top of the tub 110.

Further, the dishwasher 100 includes an extendable upper rack 120 and an extendable lower rack 130. The upper rack 120 is installed between the upper nozzle 150 and the top nozzle 155 to hold dishes and utensils when the washing water is sprayed from the upper nozzle 150 and/or the top nozzle 155. The lower rack 130 is installed between the lower nozzle 160 and the upper nozzle 150 to hold dishes and utensils when the washing water is sprayed from the lower nozzle 160 and/or the upper nozzle 150.

The upper rack 120 is slidably supported by a rail (not shown) formed on the tub 110, such that the upper rack 120 can be extended and retracted from and into the tub 110. The lower rack 130 is formed with rollers that roll along a groove defined at the door 111 when the lower rack 130 is extended from the tub 110.

An operation of the dishwasher 100 of the present invention will now be described.

A user opens the door 111 and extends the upper rack 120 and/or the lower rack 130 to load dishes or utensils. After loading the dishes or the utensils and closing the door 111, the user inputs washing conditions and presses an operation button to start a washing operation.

Upon the pressing of the operation button, a washing water (detergent-added water) is filled in the sump 170, and the motor 190 drives an impeller (not shown) of the washing pump 180 to pump the washing water from the sump 170 toward the lower nozzle 160 and the water guide 140. Here, the washing pump 180 pumps the washing water to the lower nozzle 160 and the water guide 140 in an alternating manner at regular intervals.

The water pumped to the lower nozzle 160 is sprayed upwardly to the inside of the tub 110, and the washing water pumped to the water guide 140 is sprayed to the inside of tub 110 at the top nozzle 155 and the upper nozzle 150. The sprayed washing water washes the dishes and utensils loaded in the upper rack 120 and the lower rack 130.

Herein, to wash the dishes and utensils loaded in the upper rack 120, the top nozzle 155 sprays the washing water in a downward direction, and the upper nozzle 150 sprays the washing water in an upward direction.

Also, the lower nozzle 160 sprays the washing water in an upward direction, and the upper nozzle 150 sprays the washing water from its lower spray holes in a downward direction, such that each sides of the dishes and utensils loaded in the lower rack 130 can be washed.

After washing the dishes and the utensils, the contaminated washing water flows back to the sump 170 and passes through a filter (not shown). The filtered impurities are discharged by a drain pump (not shown) when the used washing water is discharged from the dishwasher 100.

After the used washing water is discharged, pure water is filled in the sump 170 through a water inlet and it is sprayed through the upper nozzle 150 and the lower nozzle 160 in the same way as described above. The sprayed pure water rinses the dishes and utensils and then it is discharged from the dishwasher 100. After this rinsing operation, a hot air is supplied to the inside of the tub to dry the dishes and utensils. That is, the dishes and utensils are cleaned through the washing, rinsing, and drying processes of the dishwasher 100.

Figure 4:
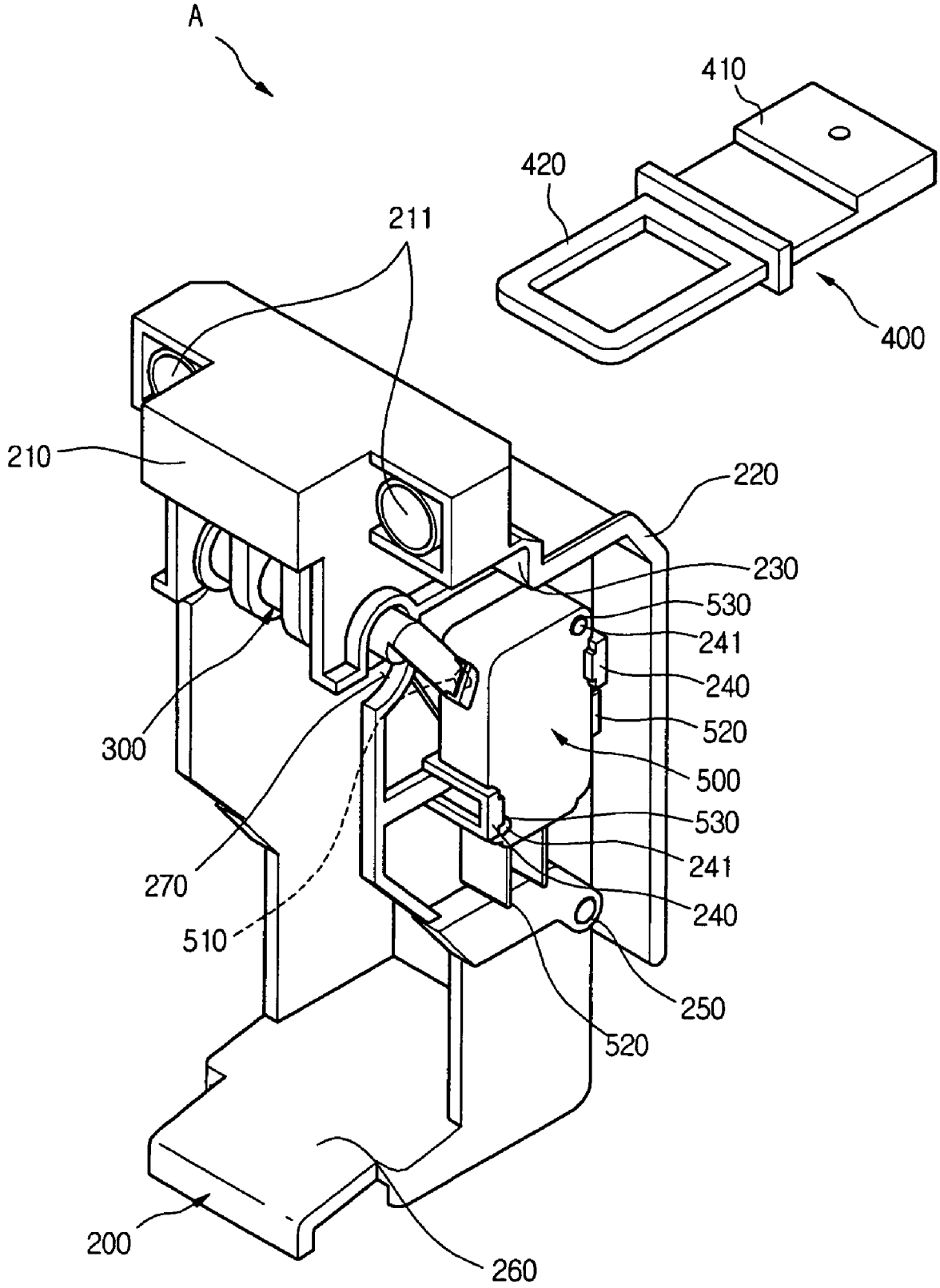
FIG. 4 is a rear perspective view of a door locking device according to the present invention.
Figure 5:
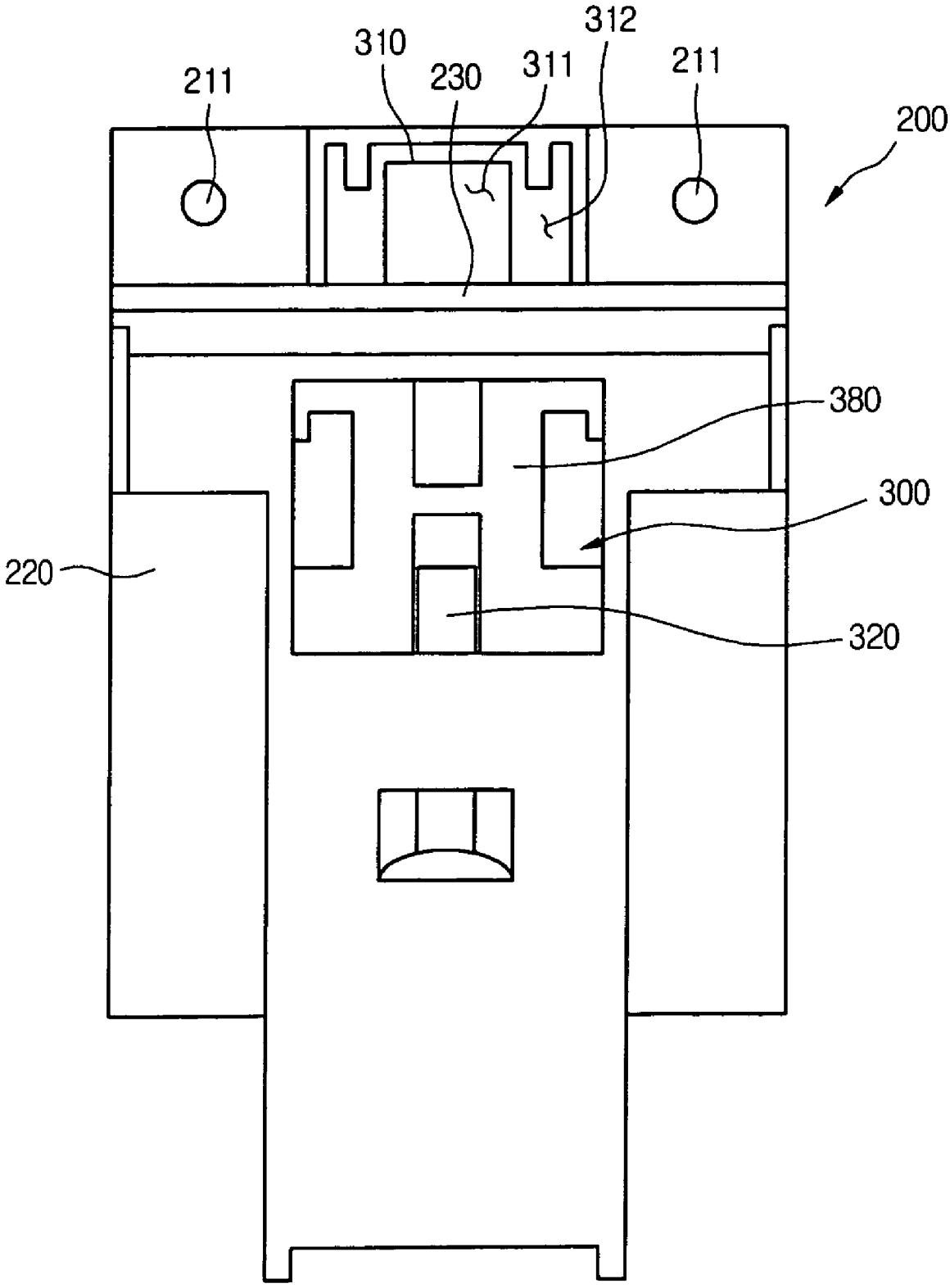
FIG. 5 is a front view of the door locking device depicted in FIG. 4.

FIG. 4 is a rear perspective view of a door locking device according to the present invention, and FIG. 5 is a front view of the door locking device depicted in FIG. 4.

Referring to FIGS. 4 and 5, the door locking device (A) of the present invention includes a latch body 200, a latch 300, and a latch lock 400. The latch body encloses inner parts and it is installed in the door 111. The latch 300 is hinged on the inside of the latch body 200 to lock the door 111 when the door 111 closes the tub 110, and the latch lock 400 is fixedly inserted in an upper edge of the tub 110 for coupling with the latch 300.

The latch lock 400 includes a tub insertion portion 410 and a latch lock ring 420 extended forwardly from the tub insertion portion 410. When assembled, the tub insertion portion 410 is inserted into the upper edge of the tub 110, and the latch lock ring 420 is protruded from the tub 110.

Figure 6:
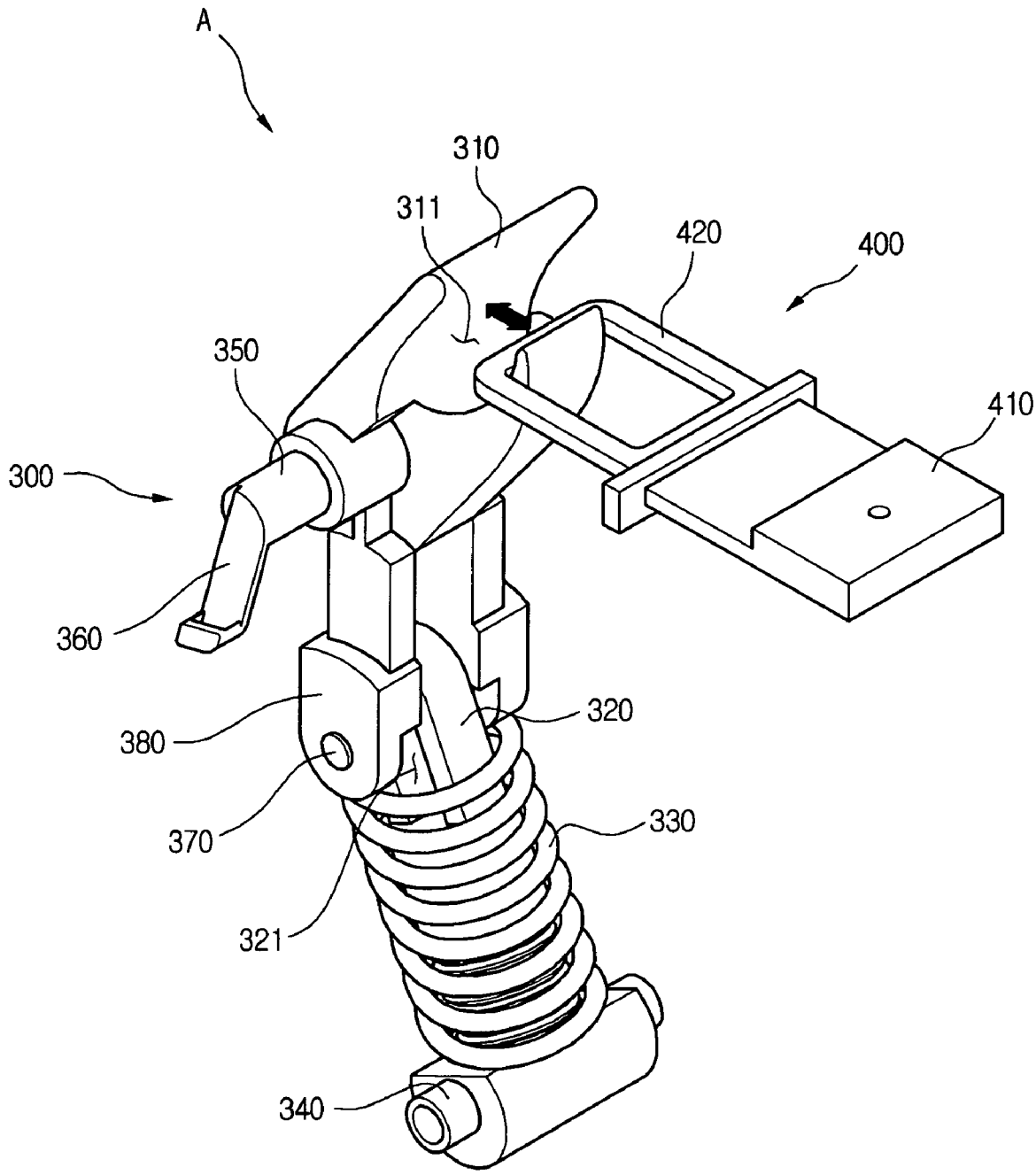
FIG. 6 is a perspective view showing a connection between a latch and a latch lock of a door locking device according to the present invention.

The latch 300 includes a latch holder (refer to 310 in FIG. 6) and a latch link (refer to 320 in FIG. 6). The latch holder 310 is fitted into the latch lock ring 420 when the door 111 is closed, and the latch link 320 is pivotably connected to a lower end of the latch holder 310. The latch 300 will be described later in detail with reference to FIG. 6.

The latch body 200 defines an accommodation space to receive the latch 300. Also, the latch body 200 is formed with a latch holder receiving portion 210 to receive the latch holder 310. At both sides of the latch holder receiving portion 210, fastener holes 211 are defined to fix the latch body 200 to the inside of the door by using fasteners such as screws.

Also, the latch body 200 defines hinge inserting holes 270 under the fastener holes 211 for coupling with latch holder hinges (refer to 350 in FIG. 6). Further, the latch body 200 includes a handle mounting portion 260 at a lower end and latch link hinge holes 250 at both sides. A handle (not shown) is to be mounted on the handle mounting portion 260 for a user to grip it.

A micro switch 500 is attached to each side of the latch body 200 to detect opening and closing of the door 111. Also, a switch cover 220 is formed at a front of the latch body 200 to prevent a washing water from permeating into the switch cover 220.

The latch body 200 includes protruded support ribs 240 to support a front and a back of the micro switch 500. Also, the latch body 200 includes fixing protrusions 241 projected from a side to support the micro switch 500. The micro switch 500 defines protrusion inserting holes 530 at corners for coupling with the fixing protrusions 241. Also, the micro switch 500 includes a contact detection part such as contact terminal 510 at a back and a wire connecting terminal 520 at a bottom and/or a side. The contact terminal 510 is protrusively formed to detect opening and closing of the door 111. The contact terminal 510 is depressed by a contact lever (refer to 360 in FIG. 6) formed at an end of the latch holder hinge 350.

Also, the latch body 200 defines a ring inserting hole 212 at a front of the latch holder receiving portion 210 to receive the latch lock ring 420 of the latch lock 400. Further, the latch body 200 is formed with a latch holder supporting portion 230 that is stepped under the ring inserting hole 212.

The latch holder supporting portion 230 prevents the latch holder 310 from being rotated too much by the latch lock ring 420 when the door 111 is opened.

The switch cover 220 is integrally formed with the latch holder supporting portion 230. The switch cover 220 is horizontally extended from the latch holder supporting portion 230 by a predetermined length and then it is bent to lengthily extend in a downward direction. That is, the switch cover 220 covers a top and a front of the micro switch 500. Therefore, a washing water permeated through the ring inserting hole 212 is prevented from flowing into the micro switch 500.

FIG. 6 is a perspective view showing a connection between a latch and a latch lock of a door locking device according to the present invention.

Referring to FIG. 6, the latch 300 of the present invention includes the latch holder 310 and the latch link 320 connected to the lower end of the latch holder 310.

The latch holder 310 has a notched portion 311 with a predetermined depth at an upper end for coupling with the latch lock ring 420. Also, the latch holder 310 includes a latch holder hinge 350 that is protruded from each side in a horizontal direction for coupling with the hinge inserting holes 270 of the latch body 200. The contact lever 360 is downwardly extended from the end of the latch holder hinge 350 to depress the contact terminal 510 of the micro switch 500. Further, the latch holder 310 includes latch holder legs 380 that are symmetrically extended in a downward direction. Between the latch holder legs 380, the upper end of the latch link 320 is pivotably inserted using a variable hinge 370.

To fit the upper end of the latch link 320 to the gap between the latch holder legs 380, the upper end of the latch link 320 has a flat shape. That is, the width of the flat portion of the latch link 320 is smaller than the width of the gap between the latch holder legs 380. The length of the flat portion is about one half of the total length of the latch link 320. The latch link 320 defines a variable hinge slot 321 at the flat portion. The variable hinge 370 is inserted through the variable hinge slot 321 and its both ends are inserted hinge holes defined in the latch holder legs 380. That is, the latch holder 310 and the latch link 320 are connected by the variable hinge 370.

The variable hinge slot 321 is extended in a length direction of the latch link 320, such that the variable hinge 370 can move up and down when the door 111 is opened and closed.

A latch spring 330 with a predetermined elasticity is fitted around the latch link 320, and a latch link hinge 340 is formed at a lower end of the latch link 320. The latch link hinge 340 is extended in a perpendicular direction to the length direction of the latch link 320.

An assembling operation of the latch 300 into the latch body 200 will now be described in detail.

First, the latch holder hinge 350 of the latch 300 is inserted into the hinge inserting holes 270 of the latch body 200, and then the latch 300 is pushed toward the accommodation space formed in the latch body 200 to insert the latch 300 in the latch body 200. Next, the latch link hinge 340 is inserted in the latch link hinge holes 250 defined in both the lower sides of the latch body 200. When assembled in this order, the latch 300 is pivotably fixed to the latch body 200 at the latch holder hinge 350 and the latch link hinge 340. Also, the variable hinge 370 reciprocates in the variable hinge slot 321 when the door 111 is opened and closed.

As shown in the accompanying drawings, the latch body 200 is characterized in that the back of the latch body 200 is opened to easily receive the latch 300. That is, the latch body 200 does not require the over-rotation preventing board that is employed in the related art, such that the latch 300 can be easily assembled into the latch body 200.

Further, the latch holder hinge 350 is directly inserted into the hinge inserting holes 270 of the latch body 200 without using a hinge pin that is required in the related art, thereby removing the inconvenience of using the hinge pin.

Furthermore, the switch cover 220 is extended from the upper front of the latch body 200 as one piece to cover the top and front of the micro switch 500, such that the washing water can be prevented from permeating through the micro switch 500.

In addition, the contact lever 360 is integrally formed with the latch holder hinge 350 to depress the contact terminal 510 formed at the back of the micro switch 500, such that the opening and closing of the door 111 can be exactly detected.

In other words, the contact lever 360 is rotated together with the latch holder 310 when the door 111 is opened and closed, such that the depressing and releasing actions of the contact lever 360 can be exactly carried out.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A door locking device for a dishwasher, comprising:

a latch lock installed at an upper edge of a tub;

a latch including a latch holder and a latch link pivotably connected to a lower end of the latch holder, the latch holder being formed with a notched portion at a front for coupling with the latch lock;

a latch body accommodating the latch, an upper portion and/or a lower portion of the latch being hinged to the latch body;

at least one detection switch attached to the latch body to detect opening and closing of the door;

a latch holder hinge extended from one or both sides of the latch holder and rotatably coupled to the latch body; and a contact lever extended and bent from the end portion of the latch holder hinge to selectively make contact with the detection switch.

2. The door locking device according to claim 1, wherein the latch body defines a hinge inserting hole at at least one side to rotatably receive the latch holder hinge.

3. The door locking device according to claim 1, wherein the detection switch is formed with a contact terminal at a predetermined side to make contact with the contact lever.

4. The door locking device according to claim 1, wherein the latch body includes a switch cover to prevent water from permeating into the detection switch.

5. The door locking device according to claim 4, wherein the switch cover covers a top and/or a front of the detection switch.

6. The door locking device according to claim 1, wherein the latch body is opened at a back to receive the latch.

7. The door locking device according to claim 1, wherein the latch body includes at least one support rib at at least one side to fixedly hold the detection switch.

8. The door locking device according to claim 1, wherein the latch body includes a hole at a front to lodge or dislodge the latch lock ring of the latch lock.

9. The door locking device according to claim 1, wherein the latch body is formed at a front with a latch holder supporting portion to prevent over rotation of the latch holder.

* * * * *